US005549084A

United States Patent [19]

Peterson, Jr.

[11] Patent Number: 5,549,084

[45] Date of Patent: Aug. 27, 1996

[54] FUEL SHUT-OFF SOLENOID PULL-IN COIL CURRENT LIMITER

[75] Inventor: Rudolph A. Peterson, Jr., Beaver Dam, Wis.

[73] Assignee: Deere & Company, Moline, Ill.

[21] Appl. No.: 557,750

[22] Filed: Nov. 13, 1995

[51] Int. Cl.[6] ..... F02N 17/00; F02B 77/00

[52] U.S. Cl. ..... 123/179.17; 123/198 DB

[58] Field of Search ..... 123/198 DB, 179.17, 123/179.3, 179.16, 198 D

[56] References Cited

U.S. PATENT DOCUMENTS

| | | | |
|---|---|---|---|
| 4,147,151 | 4/1979 | Wright | 123/196 S |
| 5,143,553 | 9/1992 | Mukaihira et al. | 123/632 |
| 5,379,733 | 1/1995 | Haddick et al. | 123/198 DB |

FOREIGN PATENT DOCUMENTS 900230685 3/1990 Japan .

*Primary Examiner*—David A. Okonsky

[57] ABSTRACT

The pull-in coil of a fuel shut-off solenoid on an engine is connected to a thermistor circuit for limiting the current to the pull-in coil. The pull-in coil is connected to ground through terminals of a control relay and through a thermistor. The activation coil of the control relay is also connected to the thermistor. When power is initially supplied to the pull-in coil, the resistance of the thermistor is low and current flow is sufficient to activate the fuel shut-off solenoid. The initial low resistance also assures that the voltage at the control relay activation coil remains near ground so the control relay initially remains deactivated. As the thermistor heats and resistance increases, pull-in coil current diminishes and voltage at the control relay increases until the control relay activates to interrupt power to the thermistor. The thermistor cools so that upon occurrence of the next pull-in solenoid activation pulse, the solenoid pull-in coil will immediately activate.

18 Claims, 1 Drawing Sheet

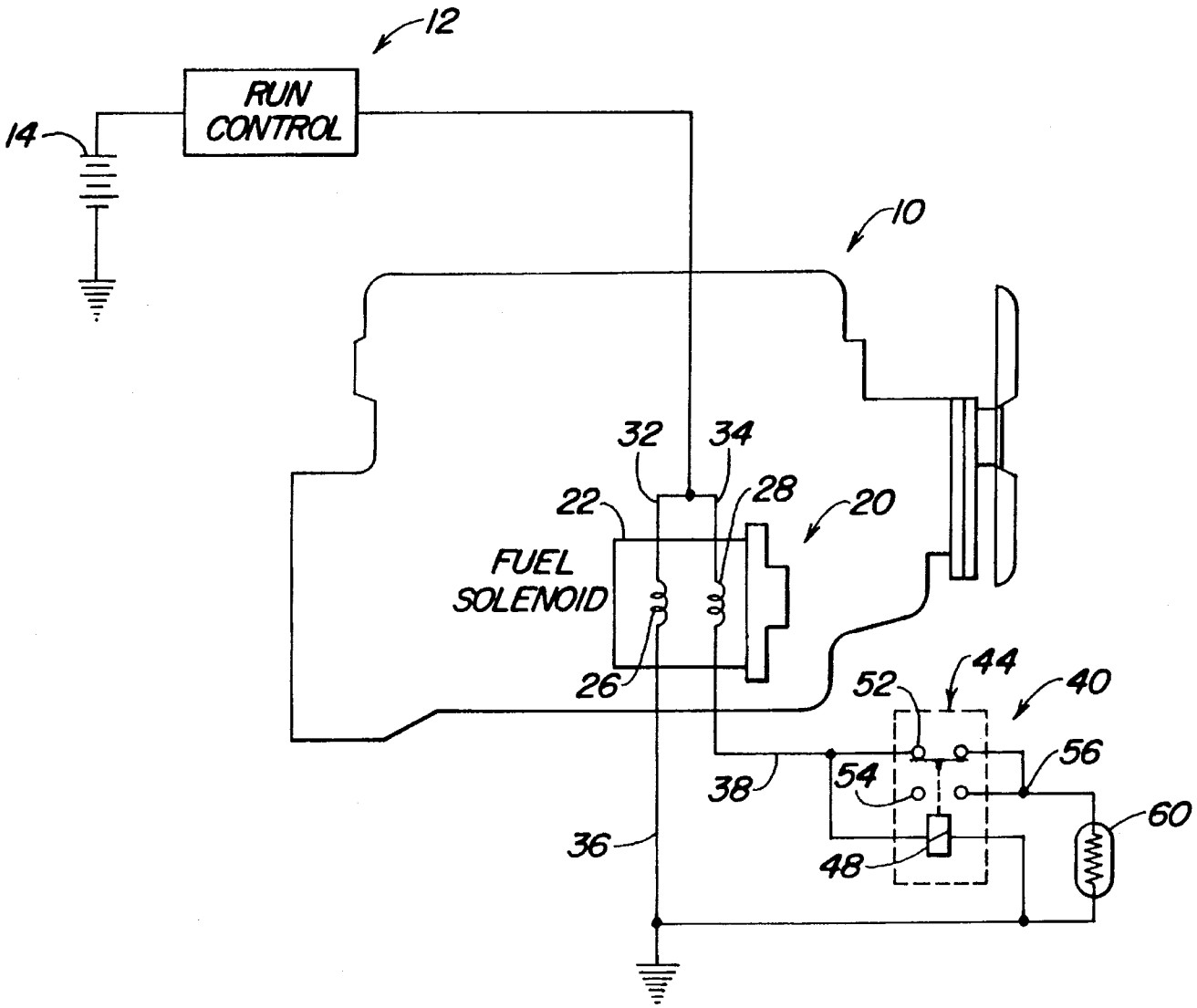
RUN CONTROL
FUEL SOLENOID
10
12
14
20
22
26
28
32
34
36
38
40
44
48
52
54
56
60

FUEL SHUT-OFF SOLENOID PULL-IN COIL CURRENT LIMITER

BACKGROUND OF THE INVENTION

1. Field of the Invention

The present invention relates generally to fuel systems on engines and, more specifically, to a circuit for limiting pull-in coil current in a solenoid such as a fuel shut-off solenoid having a coil that is temporarily activated on start-up of the engine.

2. Related Art

Fuel shut-off solenoids often are used on diesel engines to interrupt fuel flow from the injection fuel pump when the ignition is switched off. On start-up of the engine, a solenoid pull-in coil must be temporarily activated to turn on the solenoid. The pull-in coil can draw up to approximately fifty amps. Once the solenoid is activated, a hold-in coil which has a much lower current draw than the pull-in coil maintains the solenoid in the on condition, and the pull-in coil is turned off to avoid overheating. A typical starting circuit has the pull-in coil connected to the start terminal on the ignition switch. If the key is held at the start position for an extended period of time or if the key sticks in the start position, the solenoid can overheat and burn out. Some starting circuits use an electronic timer to pulse the pull-in coil for a short time, but these circuits are more complex and expensive. A thermistor can be used in the pull-in coil circuit to decrease pull-in current as the thermistor heats, but some current continues to flow through the pull-in coil circuit and the thermistor remains hot after the solenoid is activated. If power to the fuel solenoid is cut off for any reason while the thermistor is hot, the solenoid cannot be reengaged to restart the engine until the thermistor cools. As a result, unwanted delays in engine operation and restarting can occur under certain conditions.

Another type of circuit, such as shown in U.S. Pat. No. 5,379,733 which is of common ownership with the present application, utilizes a relay responsive to an increase in the engine oil pressure to cut off pull-in coil current. Since oil pressure varies considerably under differing conditions, providing a consistent pull-in coil current pulse can be a problem.

BRIEF SUMMARY OF THE INVENTION

It is therefore an object of the present invention to provide an improved circuit for the fuel shut-off of an engine. It is another object to provide such a circuit which eliminates most or all of the aforementioned problems.

It is a further object of the present invention to provide an improved solenoid circuit for an engine which limits pull-in coil current and reduces coil heating. It is a further object to provide such a circuit which is relatively simple and inexpensive in construction and which features immediate reset.

It is still another object of the present invention to provide an improved fuel shut-off circuit for an engine which utilizes a simple thermistor circuit to eliminate problems of solenoid overheating during start-up. It is a further object to provide such a circuit which resets immediately if power to the fuel solenoid is interrupted for any reason so that the engine can be started or restarted without delay.

The pull-in coil of a fuel shut-off solenoid on an engine is connected to a thermistor circuit for limiting the current to the pull-in coil. The pull-in coil is connected to ground through terminals of a control relay and through a thermistor. The activation coil of the control relay is also connected to the thermistor and is responsive to the voltage across the thermistor. When power is initially supplied to the pull-in coil, the resistance of the thermistor is low so that sufficient current flows to activate the fuel shut-off solenoid. The initial low resistance also assures that the voltage at the control relay activation coil remains low and the control relay initially remains deactivated. As the thermistor heats and resistance increases, pull-in coil current diminishes and voltage at the control relay increases until the control relay activates to interrupt power to the thermistor. A hold-in coil is provided to maintain solenoid activation after the pull-in coil drops out as long as there is power at the solenoid input. After the control relay activates, the thermistor cools in preparation for the next pull-in solenoid activation pulse. The control relay will drop out if power to the fuel shut-off solenoid is interrupted for any reason. When the control relay drops out, the limiting circuit resets and reconnects the cooled thermistor to the pull-in coil so that when power is again applied to the pull-in coil, sufficient current will flow for a preselected period of time to activate the solenoid. After solenoid activation, the increasing resistance of the thermistor results in a voltage increase at the control relay activation coil that causes the control relay to again activate and open the current path to the thermistor.

The current limiting circuit is very simple, inexpensive, and reliable. Reset is automatic and immediate as soon as power to the pull-in coil is interrupted so that the pull-in coil will energize when power is again supplied to the coil to prevent unwanted engine stalls and starting delays. The thermistor remains hot only a very short period of time. Pull-in current is automatically limited to reduce power drain and prevent coil burn-out.

These and other objects, features and advantages of the present invention will become apparent to one skilled in the art upon reading the following detailed description in view of the drawings.

BRIEF DESCRIPTION OF THE DRAWINGS

The single drawing figure is a schematic representation of an improved pull-in coil circuit with a current limiter.

DETAILED DESCRIPTION OF THE DRAWINGS

Referring now to the drawing, therein is shown a diesel engine 10 having a run control circuit 12 connected to one terminal of a battery 14 or other source of electrical power. The opposite terminal of the battery 14 is connected to ground. A fuel pump system 20 for the engine 10 includes a fuel shut-off solenoid 22 for selectively cutting off fuel flow to the engine when the engine ignition switch is turned off. The solenoid 22 includes a hold-in coil 26 and a pull-in coil 28. The coils 26 and 28 have input leads 32 and 34, respectively, connected to an output lead from the run control circuit 12. The coils 26 and 28 also have output leads 36 and 38 which are respectively connected to ground and to a pull-in coil current limiting circuit indicated generally at 40. The hold-in coil 26 has a relatively small steady state current draw, while the pull-in coil 28 has a very high current draw on the order of up to fifty amps.

The current limiting circuit 40 is connected in series with the pull-in coil 28 and includes a relay 44 having an activation coil 48. The coil 48 is connected to the lead 38 in series with the pull-in coil 28. A pair of switched leads 52 and 54 have output terminals connected to each other at 56 and to a first lead of a positive temperature coefficient thermistor 60. The opposite lead of the thermistor 60 is connected to ground. The thermistor 60 has a resistance that increases greatly with increased thermistor temperature, and the temperature quickly rises when the pull-in coil current passes through the thermistor 60.

When the relay 44 is deactivated (shown), the leads 52 are connected, and the thermistor 60 is connected in series with the pull-in coil 28. The thermistor 60, which preferably is a commercially available thermistor such as a PCL4000 previously available from Midwest Components, or an equivalent available from Thermodisc Inc., a subsidiary of Emerson Electric., has a small initial resistance to provide ample pull-in current when connected to the coil 28.

When the relay 44 is deactivated and power is applied to the lead 34, the voltage across the relay coil 48 is dependent on the voltage across the thermistor 60 which, in turn, is dependent on the temperature of the thermistor. Initially, the thermistor resistance is low and the voltage across the thermistor 60 is close to ground and insufficient to activate the relay 44. The thermistor 60 heats quickly as the high pull-in current flows therethrough, and the current through the pull-in coil 28 decreases. Within a preselected time period after power is applied from the control 12 to the solenoid 22, preferably on the order of less than about three seconds, the thermistor resistance and voltage across the thermistor increase to activate the relay 44. When the relay 44 is activated, the circuit between the pull-in coil 28 and the thermistor 60 is opened and no current flows through the thermistor, allowing it to quickly cool. The current flow through the pull-in coil 28 while the relay 44 is activated is limited to a relatively small nominal current draw of the activation coil 48. The relay 44 remains in the activated condition so long as power is supplied to the lead 34 of the pull-in coil 28. If power to the fuel solenoid 22 is interrupted for any reason, the relay 44 deactivates and connects the cooled thermistor 60 to the pull-in coil 28 so that immediately after power is resupplied to the leads 32 and 34, the pull-in coil 28 will activate the fuel solenoid 22. After the time delay established by the circuit 40, the relay 44 will again activate to open the current path to the thermistor 60 to allow the thermistor to cool and to reduce the current through the pull-in coil 28 to the small current draw of the activation coil 48. The hold-in coil 32 maintains the fuel solenoid 22 in the on condition after the time delay until power to the fuel solenoid 22 is interrupted.

Having described the preferred embodiment, it will become apparent that various modifications can be made without departing from the scope of the invention as defined in the accompanying claims.

I claim:

1. In an engine having a source of current, a fuel pump system including a solenoid having a pull-in coil for activating fuel flow during start up, the solenoid selectively connectable to a power source, a current limiting circuit comprising:

a thermistor connected to the pull-in coil and closing a current path from the power source through the pull-in coil to provide pull-in coil current, the thermistor heating up and thereby limiting pull-in current to a preselected period of time; and switch structure connected to the pull-in coil and to the thermistor for opening the current path through the thermistor and permitting the thermistor to cool after the preselected period of time.

2. The invention as set forth in claim 1 wherein the switch structure includes a first terminal connected to the pull-in coil and a second terminal connected to the thermistor, the switch structure responsive to the heating of the thermistor for opening the current path.

3. The invention as set forth in claim 2 wherein the switch structure comprises a relay, and the thermistor is connected between the second terminal of the switch structure and ground, and wherein the relay includes an activation coil connected to the first terminal for selectively activating the switch structure.

4. The invention as set forth in claim 2 wherein the switch structure assumes an open condition when the current path is opened and power is applied to the pull-in coil, and wherein in the open condition of the switch structure, power is removed from the thermistor so that the thermistor cools.

5. The invention as set forth in claim 4 wherein the switch structure resets to a closed condition when power is removed from the pull-in coil to connect the thermistor to the pull-in coil.

6. The invention as set forth in claim 4 wherein the fuel pump solenoid includes a hold-in coil for maintaining active fuel flow after the pull-in coil current is interrupted.

7. In an engine having a source of electrical power, a run control circuit connected to the source, a fuel solenoid connected to the run control circuit and including a pull-in coil for activating the solenoid with an activation current, the solenoid also including a hold-in coil for maintaining the solenoid activated with a current less than the activation current after power is removed from the pull-in coil, a current limiting circuit comprising:

a thermistor device having variable resistance;

switching structure connected to the pull-in coil and the thermistor device, the switching structure having a first state wherein the thermistor device closes a current path through the source and the pull-in coil and limits activation current to a preselected period of time, the switching structure also having a second state wherein the path through the thermistor is opened.

8. The invention as set forth in claim 7 wherein the switching structure includes a switch control input, the switch control input connected to the thermistor device and responsive to the resistance of the thermistor device for changing from the first state to the second state.

9. The invention as set forth in claim 8 wherein the switching structure comprises a relay having switched terminals and an activation coil connected to the switch control input, and wherein the activation coil is responsive to voltage across the thermistor device.

10. The invention as set forth in claim 9 wherein the activation coil is connected in series with the pull-in coil and the thermistor device is connected in parallel with the activation coil when the switching structure is in the first state.

11. The invention as set forth in claim 10 wherein the thermistor device is disconnected from the source when the switching structure is in the second state so that no current normally flows through the thermistor after the preselected period of time.

12. In an engine having a source of electrical power, a run control circuit connected to the source, a fuel solenoid connected to the run control circuit and including a pull-in coil for activating the solenoid with an activation current, the solenoid also including a hold-in coil for maintaining the solenoid activated with a current less than the activation current after power is removed from the pull-in coil, a current limiting circuit comprising:

a thermistor which heats and increases in resistance when a current flows therethrough;

switch means for selectively connecting the thermistor in series with the pull-in coil for limiting the activation current to a preselected period of time and limiting current flow through the thermistor after the preselected period of time thereby allowing the thermistor to cool after the preselected period of time.

13. The invention as set forth in claim 12 wherein the switch means comprises a relay having a first state wherein the thermistor defines a portion of a closed current path from the source through the pull-in coil, and a second state wherein the current path is open.

14. The invention as set forth in claim 12 wherein the switch means is responsive to the resistance of the thermistor.

15. The invention as set forth in claim 13 wherein the switch means includes a control terminal connected to the thermistor and the state of the relay is responsive to the resistance of the thermistor.

16. The invention as set forth in claim 15 wherein the relay changes to the second state after the preselected period of time so long as power is applied to the pull-in coil.

17. The invention as set forth in claim 16 wherein the relay includes an activation coil connected in series with the pull-in coil, and wherein the thermistor is connected in parallel with the activation coil when the relay is in the first state.

18. The invention as set forth in claim 16 wherein the relay has a reset condition wherein the relay is returned to the first state when power is removed from the pull-in coil.

* * * * *